United States Patent [19]

Shang

[11] Patent Number: 4,936,777

[45] Date of Patent: Jun. 26, 1990

[54] CONNECTOR FOR TURN-KNOB 3-WAY SWITCHED MEDIUM BASE LAMP HOLDERS

[76] Inventor: Jean Y. Shang, 1, Lane 118, San Ho Rd., Fong Ywan City, Taichong County, Taiwan

[21] Appl. No.: 385,095

[22] Filed: Jul. 26, 1989

[51] Int. Cl.[5] ..... H01R 4/24

[52] U.S. Cl. ..... 439/438

[58] Field of Search ..... 439/436–441, 439/577, 620–622

[56] References Cited

U.S. PATENT DOCUMENTS 4,257,664 3/1981 Munroe ..... 439/441

*Primary Examiner*—Joseph H. McGlynn

*Attorney, Agent, or Firm*—Morton J. Rosenberg; David I. Klein

[57] ABSTRACT

This invention is directed to an improved connector for turn-knob 3-way switched medium base lamp holders. By means of the improved structures forming the connecting holes, through which the electrical wires are inserted, to match the spring force of the connecting springs located within the lamp holder body. The electrical connection is made by the pinching action of the connecting spring against the electric wire through the holes on the top of the lamp holder body. Improved performance of this electrical connection is achieved by the grooves and bends formed in the connecting spring for applying sufficient force to provide a good electrical connection without deformation of the wire.

8 Claims, 5 Drawing Sheets

CONNECTOR FOR TURN-KNOB 3-WAY SWITCHED MEDIUM BASE LAMP HOLDERS

BACKGROUND OF THE INVENTION

1. Field of the Invention

This invention relates to an improvement of 3-way switched lamp holders. Typical lamp holders utilize two methods of connection for electrical wires, soldering or screw type connections. However, both of these methods are labor intensive, have poor reliability, and require particular tools. Whereas in the instant invention, the electrical wires are simply inserted through the holes formed in the top of the lamp holder body to allow the springs to engage the respective wires.

2. PRIOR ART

Switched 3-way medium base lamp holders are well known in the art. The best prior art known to the Applicant include U.S. Pat. Nos. 2,576,856; 2,283,405; 3,125,392; 2,713,668; and, 4,257,664, West German Pat. Nos. 1911887 and 2250456, and Great Britain Pat. No. 2040608. These references however do not disclose a turn-knob 3-way switch medium base lamp holder having the novel combination of elements as disclosed herein.

SUMMARY OF THE INVENTION

The main objective of the invention is to provide an improvement of the push-in type electrical connection for a 3-way turn-knob switched medium base lamp holder. The holes formed in the top of the lamp holder body provide a guide for the electric wires which are inserted therein and then subsequently pinched and clamped by the bent springs disposed within the lamp holder. The bent springs provide sufficent spring force to firmly pinch the electric wires, making the electrical connection without deforming the wires.

The second objective of the invention is to provide an improved push-in connector for use with the 3-way turn-knob switch. The switch includes a U-shaped contact spring as an electrical conductor, which is installed without the use of tools.

BRIEF DESCRIPTION OF THE DRAWINGS FIG. 1 is a perspective view of the lamp holder; FIG. 2 is a bottom plan view of the lamp holder; FIG. 2-1 is a top plan view of the lamp holder; FIG. 3 is a sectional view of the lamp holder taken along the section line 3—3 of FIG. 2; FIG. 4 is a sectional view of the lamp holder taken along the section line 4—4 of FIG. 1; FIG. 5 is a sectional view of the lamp holder taken along the section line 5—5 of FIG. 2; FIG. 5-1 is a perspective view of the spring connector 5; FIG. 6 is a sectional view of the lamp holder taken along the section line 6—6 of FIG. 2; FIG. 6-1 is a perspective view of the L-shaped spring connector; FIG. 7 is a sectional view of the lamp holder taken along the section line 7—7 of FIG. 2; FIG. 8 is a sectional view of the lamp holder taken along the section line 8—8 of FIG. 7; and, FIG. 8-1 is a perspective view of the U-shaped spring of the lamp holder assembly.

DESCRIPTION OF THE PREFERRED EMBODIMENTS

Figure 1:
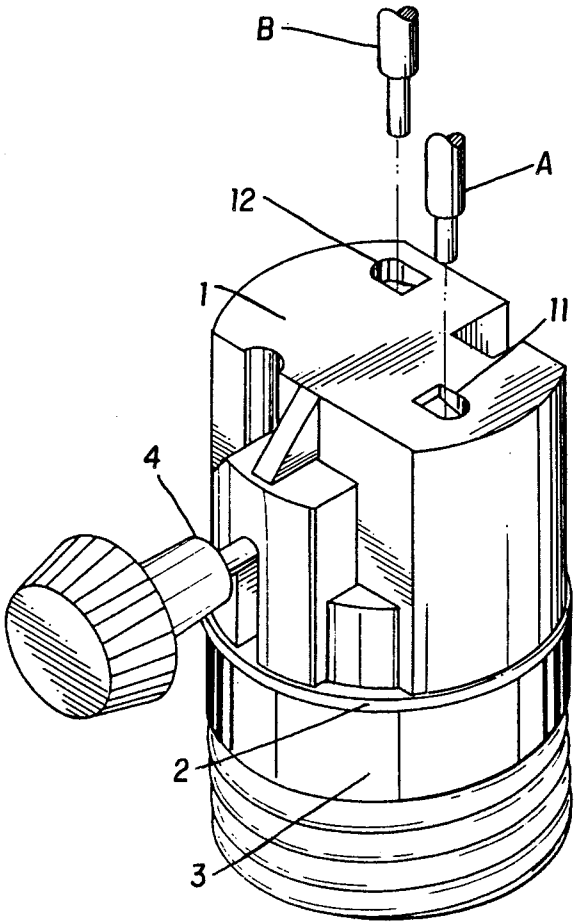
Figure 2:
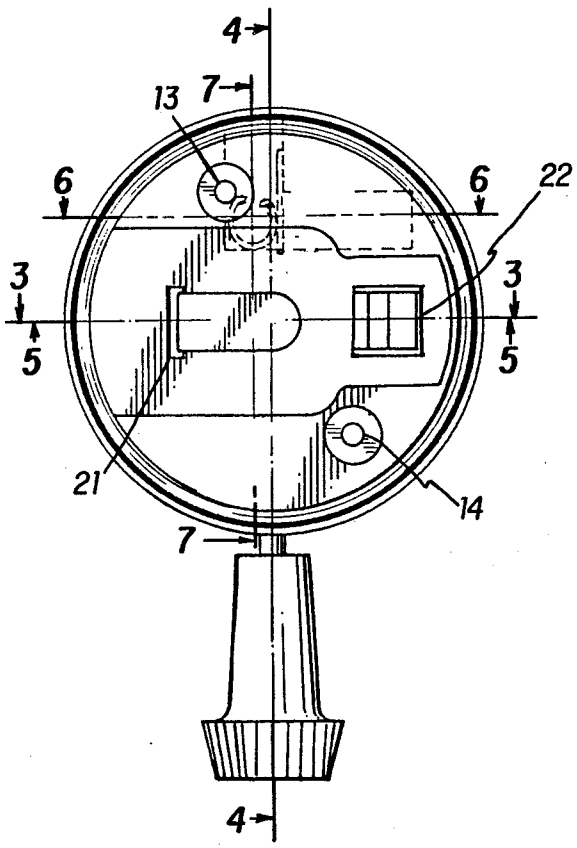

Referring to FIGS. 1 and 2, there is shown, the body 1 of the turn-knob 3-way switched medium base lamp holder according to the invention. The lamp holder includes an insulating disk 2 disposed between the metal shell 3 and the body 1. A turn-knob 4 is disposed on one side of the assembly to provide switch control, and a pair of holes 11 and 12 are formed on the top of body 1. Within the holes 11 and 12 there is located respective spring connectors for coupling with respective electric wires which are inserted into the body through the holes.

On the opposing end of the lamp holder a pair of symmetrically located holes 13 and 14 are provided for receiving rivets which couple the body 1, insulating disk 2, and metal screw shell 3 together. The insulating disk 2 is provided with a rectangular slot 21 through which the rectangular tongue spring 7 is received, and a square hole 22 is also provided for passage of the square contact terminal 63 therethrough.

Figure 3:
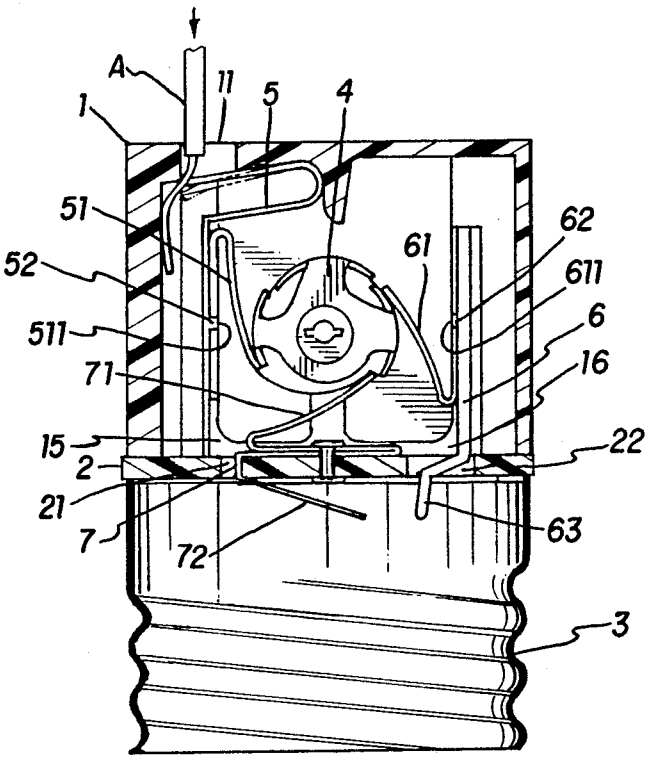
Figure 1:
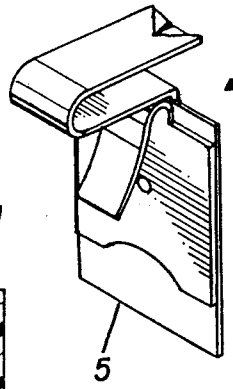

Referring to FIG. 3, there is shown, the structure of the body 1 wherein there is formed a pair of guiding slots 15 and 16. The spring connector 5 is received within the guiding slot 15, and the spring 6 is received within guiding slot 16. The tongue spring 7 is riveted to the central portion of insulating disk 2. The contact spring 71 is electrically coupled to tongue spring 7 by means of the rivet which couples tongue spring 7 to the insulating disk 2, or in the alternative, contact spring 71 is integrally formed with tongue spring 7 and is folded back upon itself and riveted in position, thereby improving the ease of assembly, and insuring a good electrical path.

The 3-way switch coupled to turn-knob 4 includes contact springs 51, 61 and 71 for forming a switched electrical path from the spring connector 5 to either one or both of spring 6 and tongue spring 7, responsive to the rotation of the disk 41 coupled to turn-knob 4. Contact spring 51 is electrically coupled to spring connector 5 by means of a compressive fit within the guide slot 15. Contact spring 51 is positioned and retained relative to contact spring connector 5 by means of a hole 511 formed in contact spring 51 for receiving a nipple 52 formed in spring connector 5. Similarly, contact spring 61 is electrically coupled to spring 6 by means of a compressive fit within the guide slot 16. Contact spring 61 is located and maintained relative to spring 6 by means of a hole 611 formed in contact spring 61 for receiving a nipple 62 formed in spring 6.

The switch function is achieved by means of an electrical contact 411 having three contact surfaces wherein each contact surface is substantially orthogonal to at least one of the other two contact surfaces, and two of the contacts are separated by approximately 180° . Using 90° rotational steps, the electrical contact 411 provides a circuit path from contact spring 51 to either contact spring 71 or contact spring 61, both contact springs 71 and 61, or neither contact springs 71 and 61. Thus achieving the standard 3-way switch function.

Figure 4:
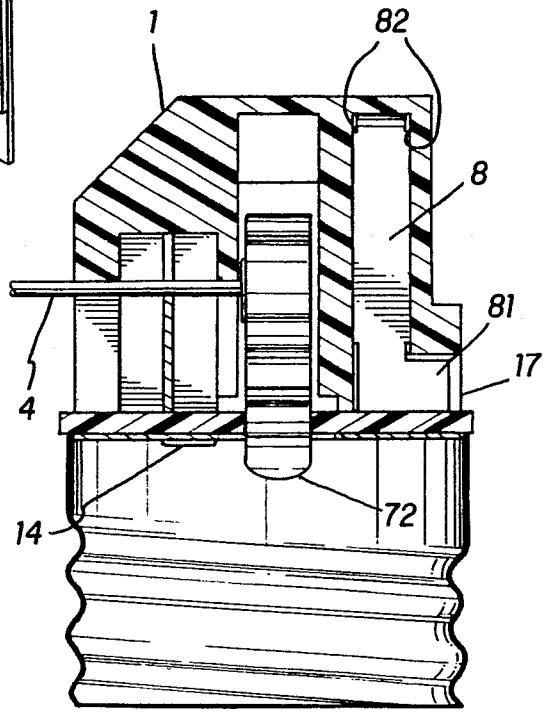

Referring to FIG. 4, there is shown the opposing side of the turn-knob 4. As shown, a deep slot is formed in the body 1 for receiving the L-shaped spring connector 8, which extends to an opening 17 formed in one side of body 1. Opening 17 is provided for insertion of the U-shaped spring 9 for making an electrical connection with a rivet 131, as will be described in following paragraphs.

Figure 5:
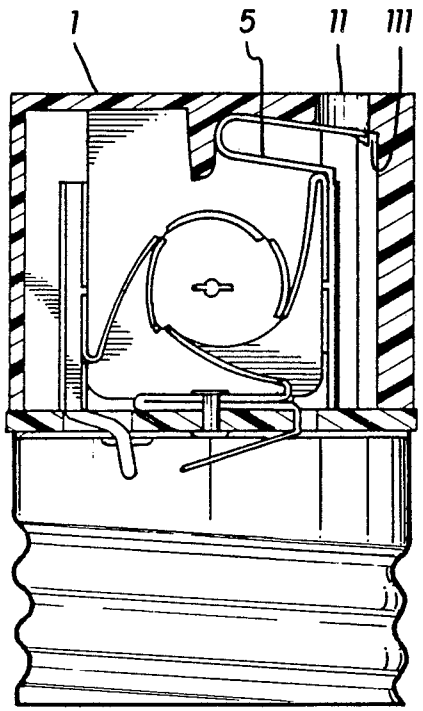
Figures 1, 6, 7:
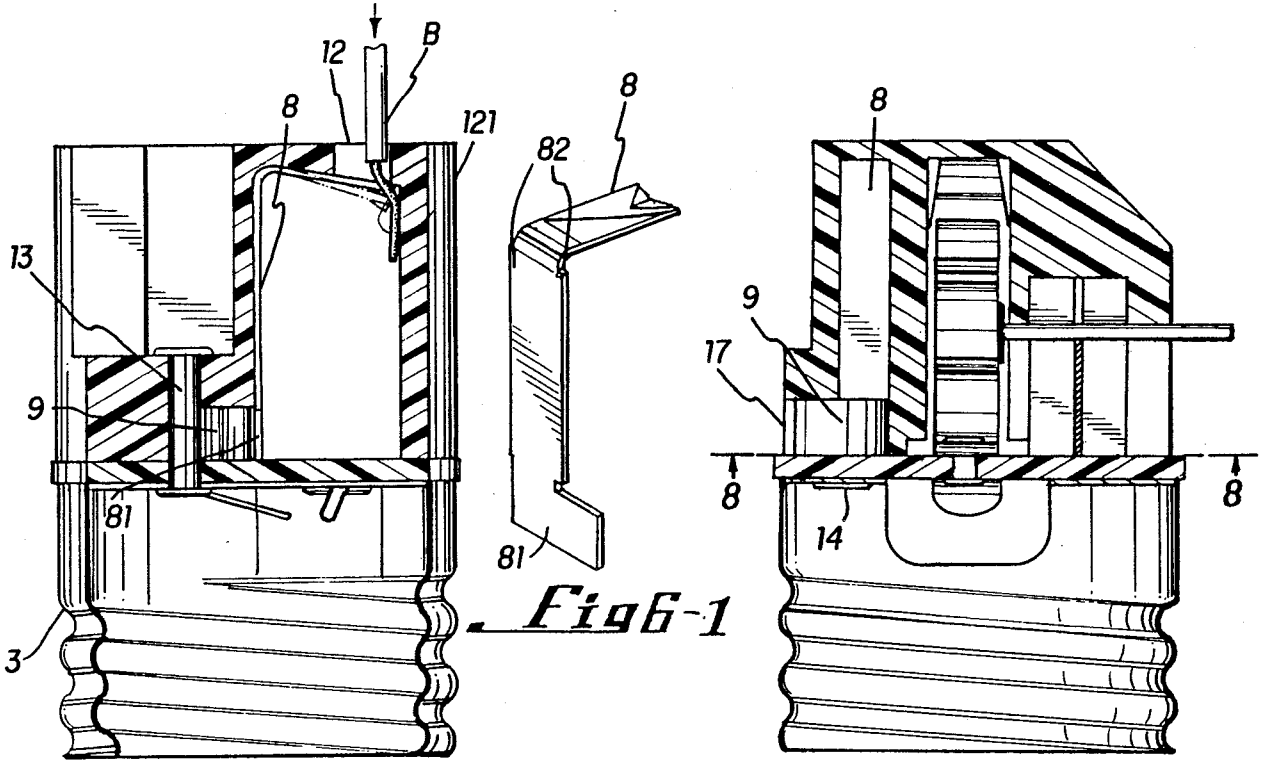

Referring to FIG. 5, a sectional view of the structure is shown wherein the spring connector 5 is shown with its oblique U-shape portion extending within the slot 15. Spring connector 5 is notched at the edge disposed adjacent the hole 11, as shown in FIGS. 5 and 5-1. The notched end of spring connector 5 extends and contacts the inside wall 111 of hole 11 such that when an electrical wire is inserted into hole 11 the spring connector 5, by virtue of the notch, is displaced from the wall and exerts a spring force to pinch the wire firmly and prevent its breaking free therefrom.

As shown in FIGS. 6, 6-1, 7 and 8-1, the L-shaped spring connector 8 is notched at the tip 121, the tip 21 normally located in contact with the inside wall of hull 12, prior to insertion of a wire. When an electric wire is inserted into hull 12, the L-shaped spring connector 8 firmly grasps the wire with the notched edge.

To provide an electrical path between the L-shaped spring connector 8 and the rivet 131, which is coupled to the metal screw shell 3, a U-shaped spring 9 is provided. The U-shaped spring 9 is inserted through the opening 17 formed in the body 1 and under compressive force contacts the lower portion 81 of L-shaped spring connector 8 and the body of rivet 131. Thus, an electrical path is formed from the wire lead "B" through the L-shaped spring connector 8 to the screw shell 3 by means of the U-shaped spring 9 and rivet 131.

The electrical path from lead "A" is made through the spring connector 5 to the contact spring 51 for coupling with the electrical contact 411. Responsive to the position of disk 41 electrical contact 411 provides an electrical path to contact spring 71, which in turn is coupled to the tongue spring 7, or to contact spring 61 for providing a path to the spring 6 having an end 63 for contacting the respective lamp terminal, or both contact springs 71 and 61, creating the two circuit paths, as previously described.

Figures 1, 8:
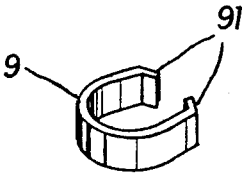
Figure 8:
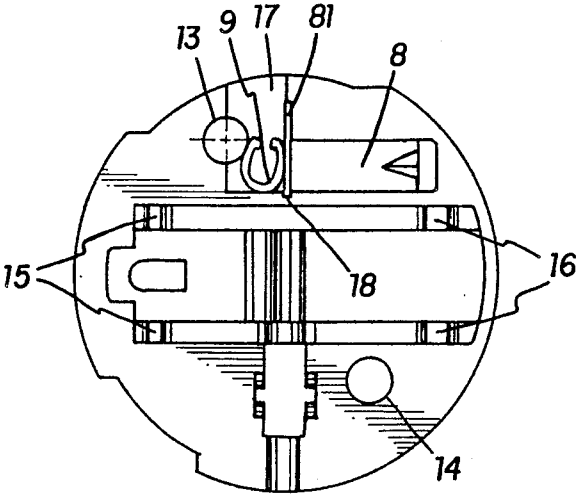
Figures 1, 2:
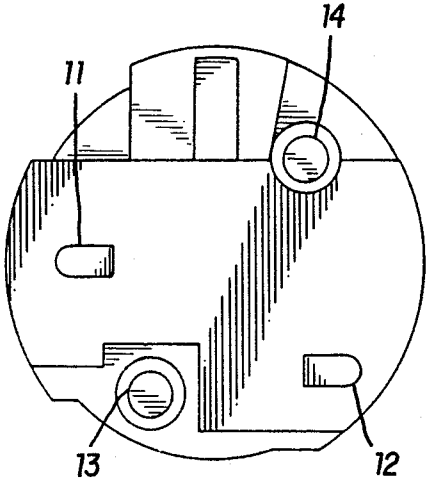

Referring to FIGS. 8 and 8-1, the spring connector 5 and the spring 6 are each individually inserted into respective slots 15 and 16 where they are stably held along with respective contact springs 51 and 61. The respective dimensions between the spring connector 5, spring 6 and slots 15 and 16 have been predetermined to provide a tight fit to prevent displacement of the springs when the turn-knob 3-way switch is operated.

Thus, a lamp holder assembly is constructed in a simple manner without the requirement for soldering tools or screwdriving tools. Electrical paths are made within the assembly by the interface between spring parts which are forced one against the other due to the structural relationship of those parts within the lamp holder body 1. Of particular importance, is the means by which the screw shell 3 is electrically coupled to the L-shaped contact spring 8. This connection is simply made by the insertion of the U-shaped spring 9 through the opening 17, wedging the U-shaped spring 9 between the lower portion 81 of L-shaped spring connector 8 and the rivet 131, as shown in FIG. 2.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An improved connector for turn-knob 3-way switched medium base lamp holder having a housing coupled to a metallic screwshell by at least a pair of metallic rivets and electrically insulated therefrom by an insulating disk, comprising;

a first spring connection member disposed within said housing for lockingly engaging a respective electrical wire lead, said first spring connection member having an upper portion having a U-shaped contour, said upper portion extending across one of a pair of wire receiving through openings formed in an upper wall of said housing;

a second spring connection member disposed within said housing for lockingly engaging a respective electrical wire lead, said second spring connection member having an upper portion bent at an oblique angle with respect to the remaining portion of said second spring connection member, said upper portion extending across an other of said pair of wire receiving through openings formed in said upper wall of said housing;

a U-shaped spring member disposed within said housing subsequent to insertion through an opening formed in a side wall of said housing, whereby said U-shaped spring member electrically couples said second spring connection member to one of said rivets; and, three-way switch means disposed within said housing and electrically coupled to said first spring connection member for selectively making or breaking an electrical path to either one or both of a pair of electrical terminals.

2. The improved connector for turn-knob 3-way switched medium base lamp holder as recited in claim 1 where said first spring connection member includes a notch formed on an end portion of said upper U-shaped portion for lockingly engaging a respective electrical wire lead without substantial deformation thereof.

3. The improved connector for turn-knob 3-way switched medium base lamp holder as recited in claim 1 where said second spring connection member includes a notch formed on an end portion of said upper bent portion for lockingly engaging a respective electrical wire lead without substantial deformation thereof.

4. The improved connector for turn-knob 3-way switched medium base lamp holder as recited in claim 1 where said three-way switch means includes a multicontact member rotatably mounted within said housing and having three contact surfaces displaced radially at increments approximating 90 degrees.

5. The improved connector for turn-knob 3-way switched medium base lamp holder as recited in claim 4 where said three-way switch means further includes a first spring contact member coupled to said first spring connection member and disposed for sliding contact with said contact surfaces of said multicontact member.

6. The improved connector for turn-knob 3-way switched medium base lamp holder as recited in claim 5 where said three-way switch means further includes a second spring contact member coupled to a centrally located one of said pair of contact terminals and disposed for sliding contact with said contact surfaces of said multicontact member.

7. The improved connector for turn-knob 3-way switched medium base lamp holder as recited in claim 6 where said three-way switch means further includes a third spring contact member coupled to another of said pair of contact terminals and disposed for sliding contact with said contact surfaces of said multicontact member.

8. The improved connector for turn-knob 3-way switched medium base lamp holder as recited in claim 6 where said second spring contact member is integrally formed in one-piece formation with said centrally located contact terminal.

* * * * *